US006405386B1

(12) United States Patent
Chang

(10) Patent No.: US 6,405,386 B1
(45) Date of Patent: Jun. 18, 2002

(54) COMBINATION HYDROTHERAPY SWIM POOL STRUCTURE

(76) Inventor: Kuo-Chen Chang, No. 367, Tsu-Yu Rd., Sec. 4, Taichung City (TW)

( * ) Notice: Subject to any disclaimer, the term of this patent is extended or adjusted under 35 U.S.C. 154(b) by 0 days.

(21) Appl. No.: 09/903,995

(22) Filed: Jul. 12, 2001

(30) Foreign Application Priority Data

Oct. 12, 2000 (TW) ..... 89217917 U

(51) Int. Cl.[7] ..... E04H 4/04
(52) U.S. Cl. ..... 4/506; 4/585; 220/9.4
(58) Field of Search ..... 4/506, 584, 585; 220/4.16, 4.17, 9.4

(56) References Cited

U.S. PATENT DOCUMENTS 1,664,887 A * 4/1928 Kirkham et al. ..... 4/506 X
3,874,132 A * 4/1975 Mendelow et al. ..... 4/506 X
5,875,500 A * 3/1999 Shaanan et al. ..... 4/506

FOREIGN PATENT DOCUMENTS

SU 478106 * 8/1975 ..... 4/506

* cited by examiner

*Primary Examiner*—Robert M. Fetsuga
(74) *Attorney, Agent, or Firm*—Connolly Bove Lodge & Hutz

(57) ABSTRACT

The present invention relates to a combination hydrotherapy swim pool structure including a plurality of side rods assembled with a plurality of transverse rods to form a swim pool support frame. An enclosure is mounted on the side rods and the transverse rods. Thus, the present invention forms a simple swim pool that can be assembled and dismantled easily and quickly. The enclosure is formed with multiple water inlet/outlet holes, and a water output control device has multiple connecting pipes each connected to the water inlet/outlet hole for ejecting water beams, thereby massaging the human body in a hydrotherapy manner. An air cushion is mounted on the periphery of the swim pool support frame, thereby keeping the water temperature of the hydrotherapy swim pool structure, and providing a comfortable sensation to the user, so as to achieve the hydrotherapy massaging effect with comfort and safety.

5 Claims, 5 Drawing Sheets

COMBINATION HYDROTHERAPY SWIM POOL STRUCTURE

BACKGROUND OF THE INVENTION

1. Field of the Invention

The present invention relates to a combination hydrotherapy swim pool structure, and more particularly to a combination hydrotherapy swim pool structure that can be assembled and dismantled easily and quickly.

2. Description of the Related Art

The closest prior art of which the applicant is aware is disclosed in the Taiwanese Patent Publication No. 365817, entitled by "HYDROTHERAPY SYSTEM STRUCTURE", which includes a bath assembled with a water supply device. However, the entire structure is very complicated, so that the user cannot assemble such a structure by himself.

Another closest prior art of which the applicant is aware is disclosed in the Taiwanese Patent Publication No. 395586, entitled by "MR PUMPING SWIM POOL WITH A REINFORCED STRUCTURE". However, the air pumping swim pool is not provided with a support frame, so that it is easily distorted and deformed. In addition, the user cannot assemble such an air pumping swim pool by himself.

SUMMARY OF THE INVENTION

The primary objective of the present invention is to provide a combination hydrotherapy swim pool structure including a plurality of side rods, and a plurality of transverse rods assembled with the side rods to form a swim pool support frame. An enclosure is mounted on the side rods and the transverse rods. Thus, the present invention forms a simple swim pool that can be assembled and dismantled easily and quickly. The enclosure has a side wall formed with a plurality of water inlet/outlet holes, and a water output control device has a plurality of connecting pipes each connected to each of the water inlet/outlet holes of the enclosure, for ejecting water beams, thereby achieving the effect of massaging the human body in a hydrotherapy manner. In addition, an air cushion is mounted around the periphery of the swim pool support frame, thereby constantly keeping the water temperature of the hydrotherapy swim pool structure, and thereby providing a comfortable sensation to the user, so as to achieve the hydrotherapy massaging effect with comfort and safety.

In accordance with the present invention, there is provided a combination hydrotherapy swim pool structure, comprising:

a plurality of side rods, and a plurality of transverse rods assembled with the side rods symmetrically to form a swim pool support frame;

wherein, each transverse rod has two distal ends each formed with a connecting plate defining an axial hole, each side rod has a top formed with a threaded post in turn extended through the axial hole of the connecting plate of one transverse rod, through the axial hole of the connecting plate of another adjacent transverse rod, through a positioning base, and secured in a rotary knob which securely screws and combine the side rod and the two adjacent transverse rods integrally, an enclosure mounted on the side rods and the transverse rods and formed with an opening facing upward, and an air cushion is mounted on the enclosure and around a periphery of the swim pool support frame.

Each distal end of each of the transverse rods has a resting face, and the positioning base has two sides each formed with a resting inclined face rested on the resting face of each distal end of each of the transverse rods.

The enclosure has a side wall formed with a plurality of water inlet/outlet holes, and the combination hydrotherapy swim pool structure also comprises a water output control device having a plurality of connecting pipes each connected to a respective water inlet/outlet hole of the enclosure.

The water output control device can be used to regulate a water ejection pressure, to regulate a water temperature, and to filter a water quality.

The enclosure has a bottom having a periphery provided with a plurality of positioning plates each secured to a bottom of each side rod.

Further benefits and advantages of the present invention will become apparent after a careful reading of the detailed description with appropriate reference to the accompanying drawings.

DETAILED DESCRIPTION OF THE INVENTION

Figure 1:
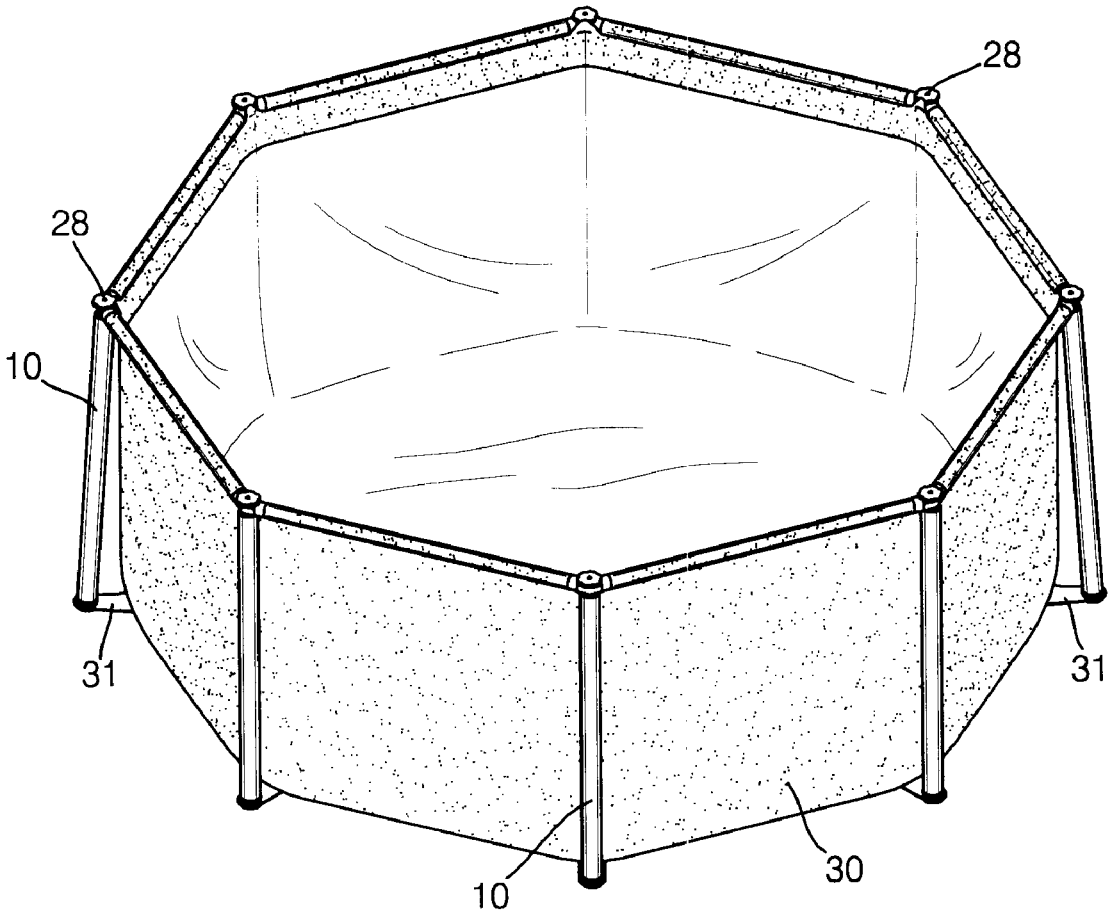
FIG. 1 is a perspective view of a combination hydrotherapy swim pool structure in accordance with a first embodiment of the present invention.
Figure 2:
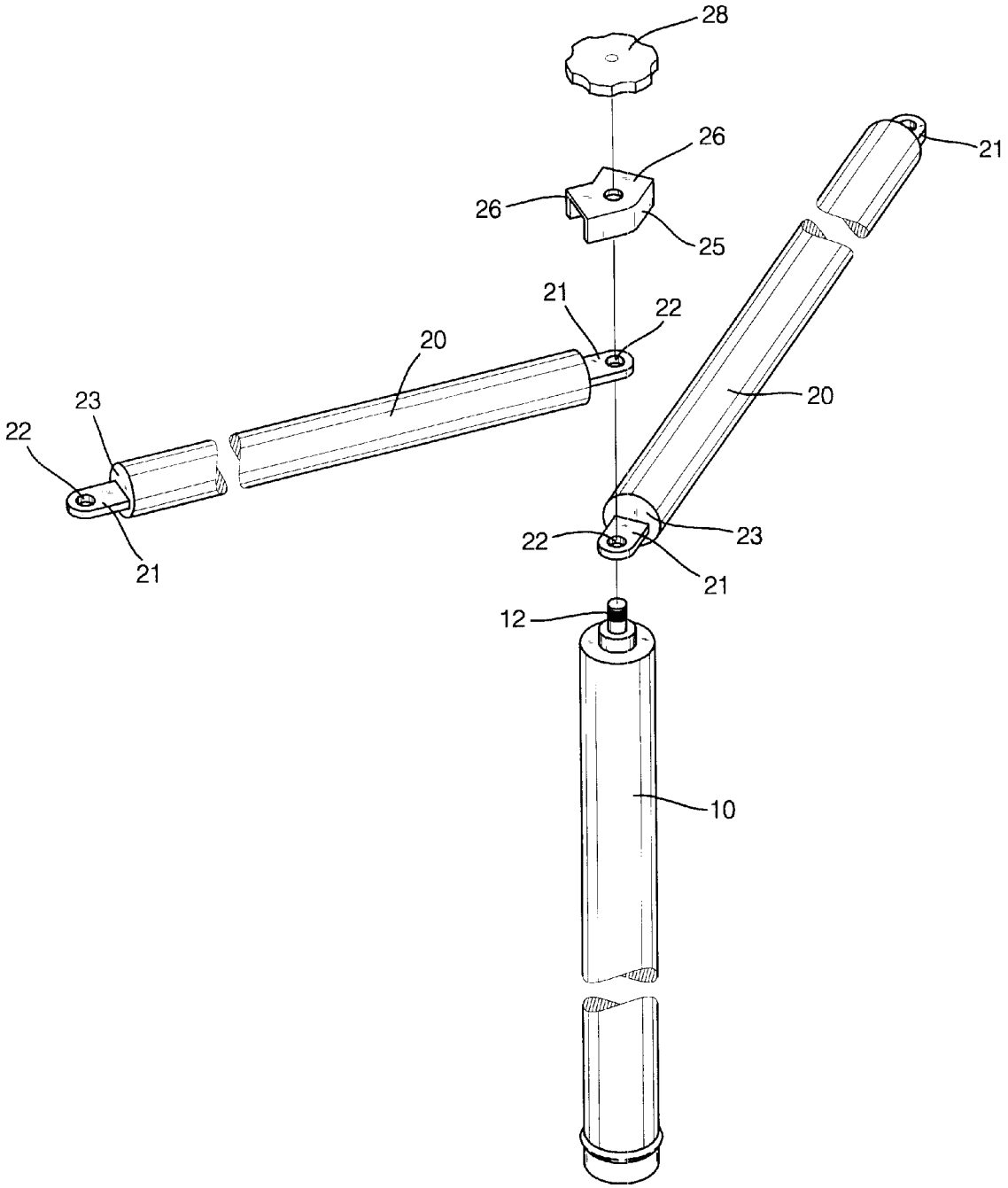
FIG. 2 is a partially exploded perspective view of the combination hydrotherapy swim pool structure as shown in FIG. 1.
Figure 3:
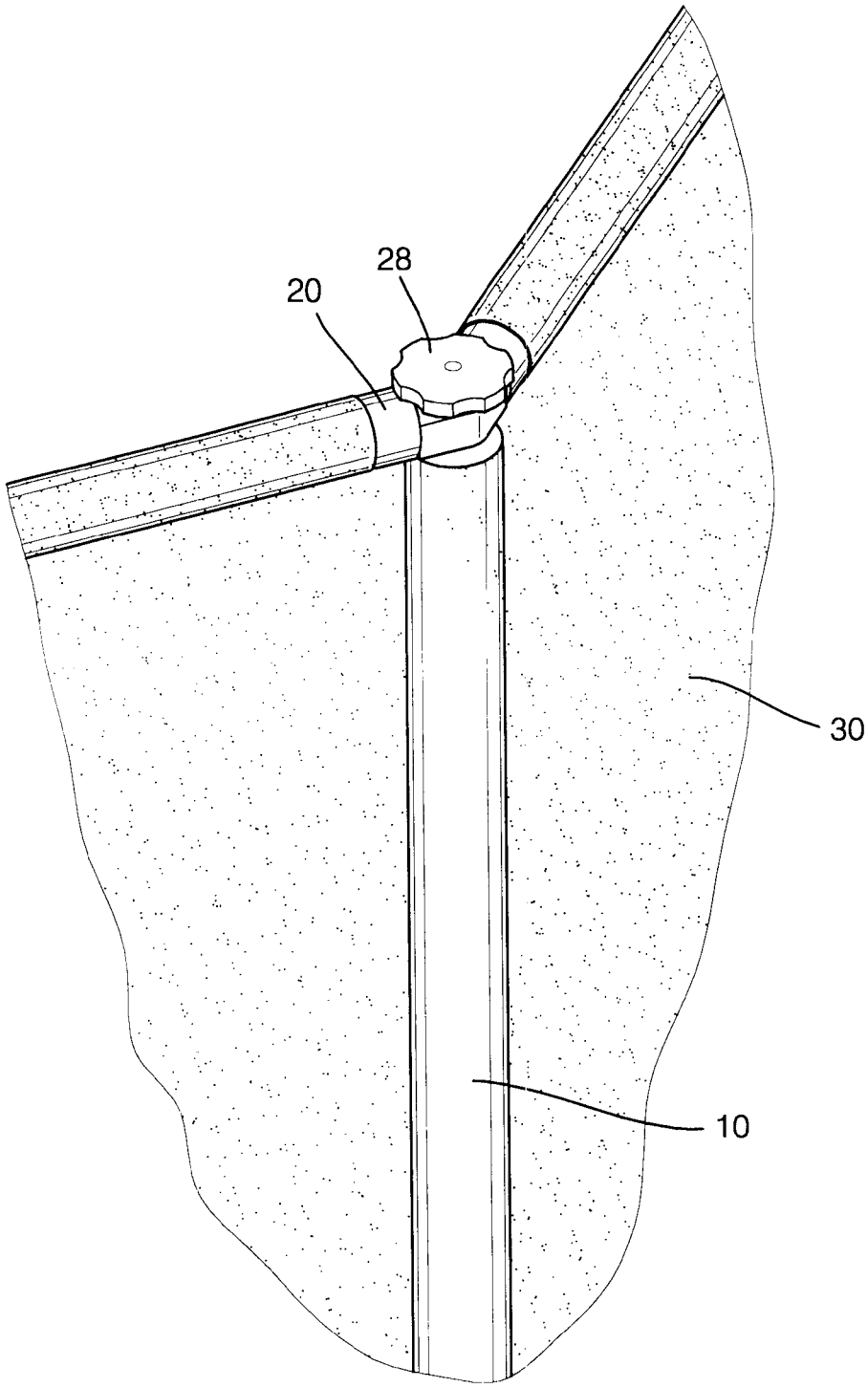
FIG. 3 is a locally enlarged view of the combination hydrotherapy swim pool structure as shown in FIG. 1.

Referring to the drawings and initially to FIGS. 1—3, a combination hydrotherapy swim pool structure in accordance with a first embodiment of the present invention comprises a plurality of side rods 10, and a plurality of transverse rods 20 assembled with the side rods 10 symmetrically to form a swim pool support frame.

Each transverse rod 20 has two distal ends each formed with a connecting plate 21 defining an axial hole 22. Each side rod 10 has a top formed with a threaded post 12 in turn extended through the axial hole 22 of the connecting plate 21 of one transverse rod 20, then through the axial hole 22 of the connecting plate 21 of another adjacent transverse rod 20, then through a positioning base 25, and finally secured in a rotary knob 28 which securely screws and combine the side rod 10 and the two adjacent transverse rods 20 integrally.

Each distal end of each of the transverse rods 20 has a resting face 23, and the positioning base 25 has two sides each formed with a resting inclined face 26 rested on the resting face 23 of each distal end of each of the transverse rods 20, so that the multiple transverse rods 20 can be combined with each other rigidly and stably, without detachment and displacement.

An enclosure 30 is mounted on the side rods 10 and the transverse rods 20 and is formed with an opening facing upward. The enclosure 30 has a bottom having a periphery provided with a plurality of positioning plates 31 each secured to a bottom of each side rod 10, so that the bottom face of the enclosure 30 can be expanded in a smooth and flat manner. Preferably, the enclosure 30 is made of plastic material having a tough feature.

Figure 4:
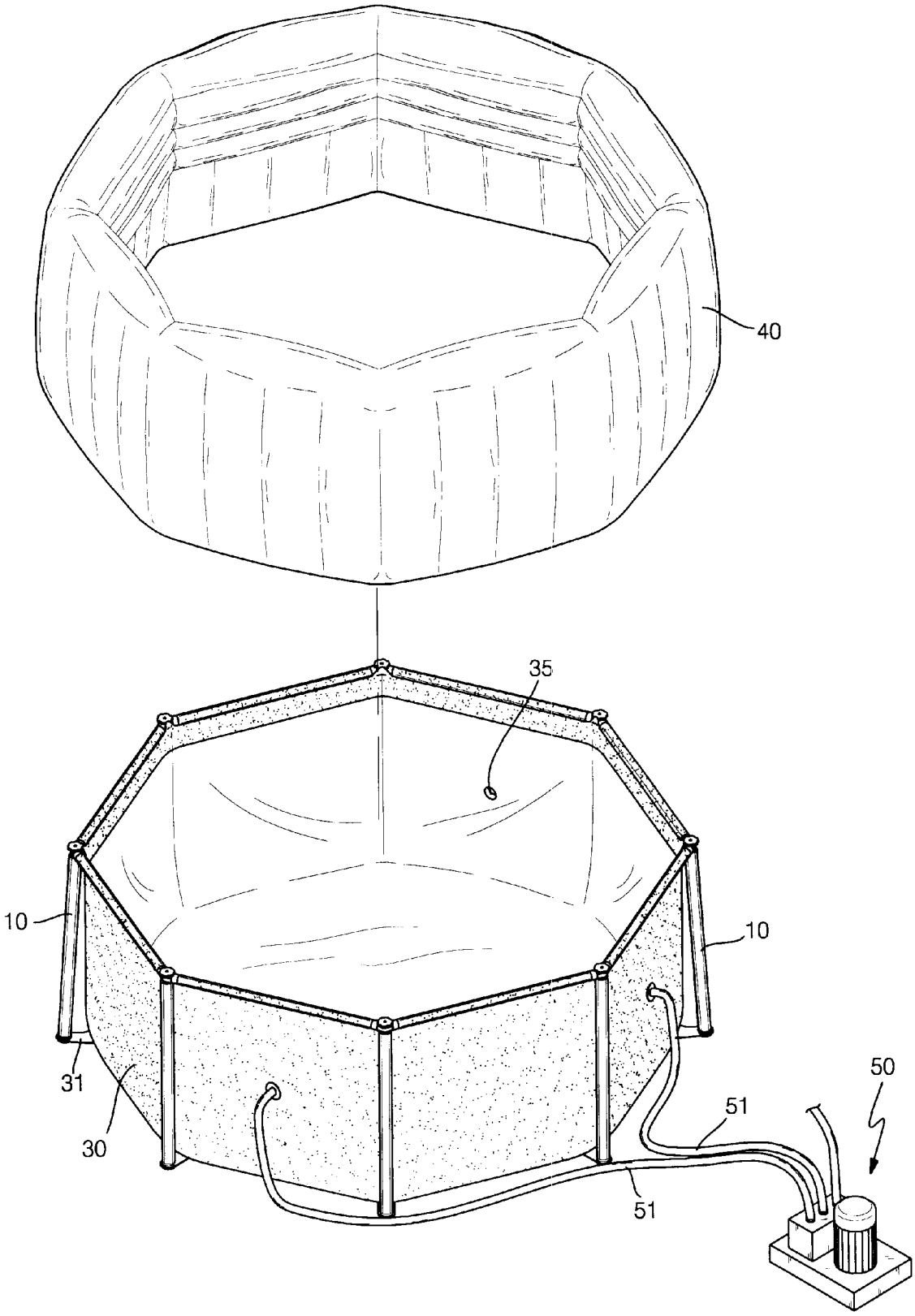
FIG. 4 is a partially exploded perspective view of a combination hydrotherapy swim pool structure in accordance with a second embodiment of the present invention.
Figure 5:
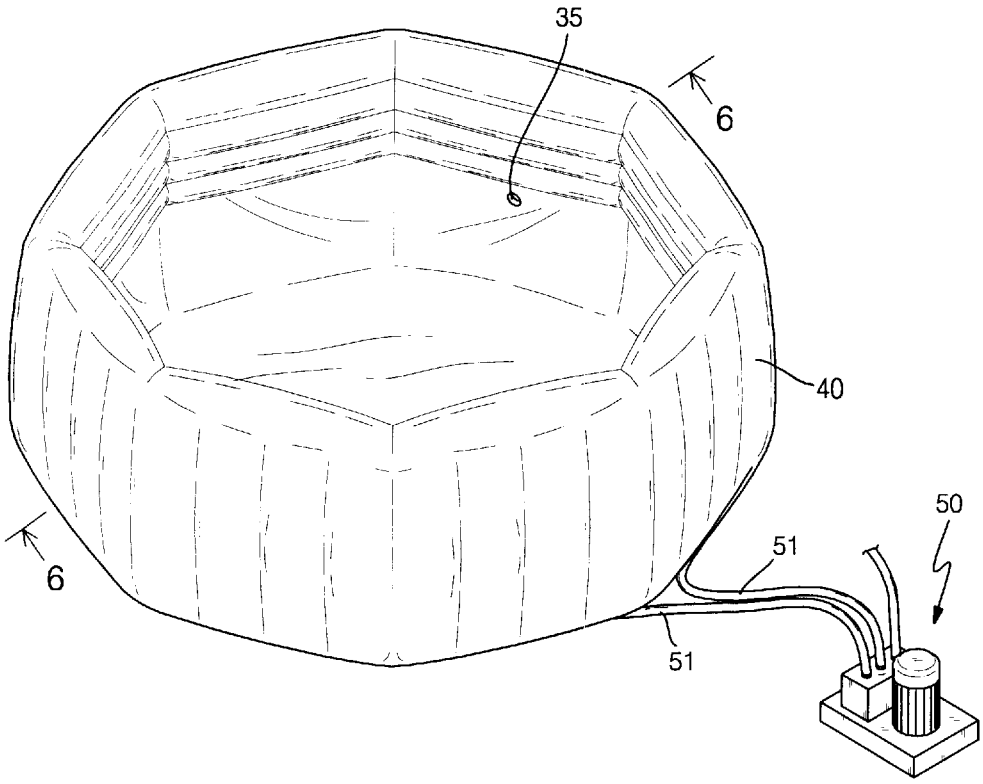
FIG. 5 is a perspective view of the combination hydrotherapy swim pool structure as shown in FIG. 4.
Figure 6:
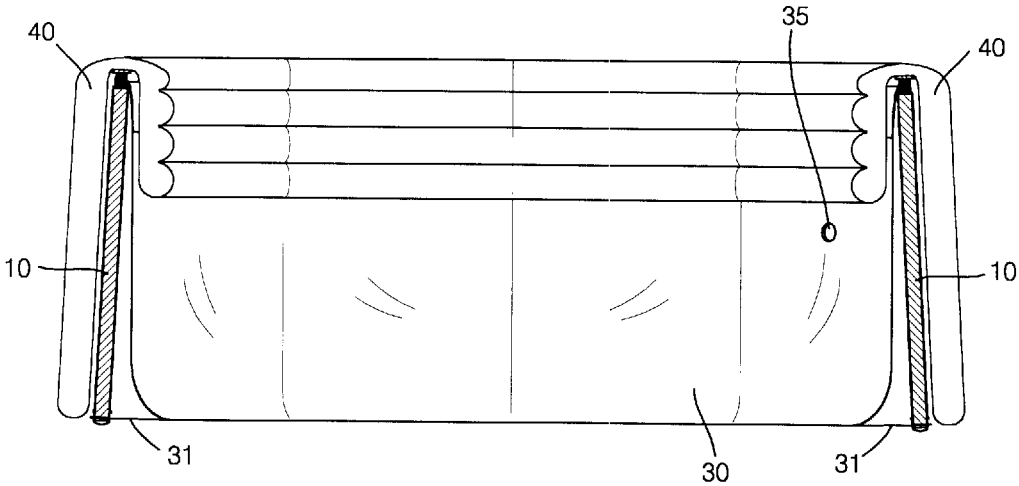
FIG. 6 is a cross-sectional view of the combination hydrotherapy swim pool structure along line 6—6 as shown in FIG. 5.

Referring to FIGS. 4–6, in accordance with a second embodiment of the present invention, the enclosure 30 has a side wall formed with a plurality of water inlet/outlet holes 35. A water output control device 50 has a plurality of connecting pipes 51 each connected to a respective water inlet/outlet hole 35 of the enclosure 30. The water output control device 50 can be used to regulate the water ejection pressure, to regulate the water temperature, and to filter the water quality, thereby enhancing the water circulation and controlling the water temperature of the combination hydrotherapy swim pool structure. The water output control device may eject multiple strong water beams through the water inlet/outlet holes 35 of the enclosure 30, thereby achieving the effect of massaging the human body in a hydrotherapy manner. In addition, an air cushion 40 is mounted on the enclosure 30 and around the periphery of the swim pool support frame, thereby constantly keeping the water temperature of the hydrotherapy swim pool structure, and thereby providing a comfortable sensation to the user, so as to achieve the hydrotherapy massaging effect with comfort and safety.

In conclusion, the present invention is to provide a combination hydrotherapy swim pool structure including a plurality of side rods, and a plurality of transverse rods assembled with the side rods to form a swim pool support frame. An enclosure is correspondingly mounted on the side rods and the transverse rods. Thus, the present invention forms a simple swim pool that can be assembled and dismantled easily and quickly. The enclosure has a side wall formed with a plurality of water inlet/outlet holes, and a water output control device has a plurality of connecting pipes each connected to each of the water inlet/outlet holes of the enclosure, for ejecting water beams, thereby achieving the effect of massaging the human body in a hydrotherapy manner. In addition, an air cushion is mounted around the periphery of the swim pool support frame, thereby constantly keeping the water temperature of the hydrotherapy swim pool structure, and thereby providing a comfortable sensation to the user, so as to achieve the hydrotherapy massaging effect with comfort and safety.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A combination hydrotherapy swim pool structure, comprising:

a plurality of side rods (10), and a plurality of transverse rods (20) assembled with said side rods (10) symmetrically to form a swim pool support frame;

wherein, each transverse rod (20) has two distal ends each formed with a connecting plate (21) defining an axial hole (22), each side rod (10) has a top formed with a threaded post (12) in turn extended through said axial hole (22) of said connecting plate (21) of one transverse rod (20), through said axial hole (22) of said connecting plate (21) of another adjacent transverse rod (20), through a positioning base (25), and secured in a rotary knob (28) which securely screws and combine said side rod (10) and said two adjacent transverse rods (20) integrally, an enclosure (30) mounted on said side rods (10) and said transverse rods (20) and formed with an opening facing upward, and an air cushion (40) is mounted on said enclosure (30) and around a periphery of said swim pool support frame.

2. The combination hydrotherapy swim pool structure in accordance with claim 1, wherein each distal end of each of said transverse rods (20) has a resting face (23), and said positioning base (25) has two sides each formed with a resting inclined face (26) rested on said resting face (23) of each distal end of each of said transverse rods (20).

3. The combination hydrotherapy swim pool structure in accordance with claim 1, wherein said enclosure (30) has a side wall formed with a plurality of water inlet/outlet holes (35), and said combination hydrotherapy swim pool structure further comprises a water output control device (50) having a plurality of connecting pipes (51) each connected to a respective water inlet/outlet hole (35) of said enclosure (30).

4. The combination hydrotherapy swim pool structure in accordance with claim 3, wherein said water output control device (50) can be used to regulate a water ejection pressure, to regulate a water temperature, and to filter a water quality.

5. The combination hydrotherapy swim pool structure in accordance with claim 1, wherein said enclosure (30) has a bottom having a periphery provided with a plurality of positioning plates (31) each secured to a bottom of each side rod (10).

* * * * *